United States Patent [19]

Ito

[11] 4,104,880

[45] Aug. 8, 1978

[54] EXHAUST GAS PURIFYING SYSTEM HAVING A DIAPHRAGM TYPE CONTROL VALVE

[75] Inventor: Mikiji Ito, Nagoya, Japan

[73] Assignee: Nippondenso Co., Ltd., Kariya, Japan

[21] Appl. No.: 681,050

[22] Filed: Apr. 28, 1976

[30] Foreign Application Priority Data

Apr. 29, 1975 [JP] Japan ..... 50-51699

[51] Int. Cl.[2] ..... F01N 3/10; F02B 75/10

[52] U.S. Cl. ..... 60/290; 236/101 C

[58] Field of Search ..... 60/290, 289; 137/DIG. 8; 123/117 A, 97 B, 124 R, 124 A; 251/51, 55; 236/101 C

[56] References Cited

U.S. PATENT DOCUMENTS

| | | | |
|---|---|---|---|
| 3,919,843 | 11/1975 | Arnaud | 60/290 |
| 3,960,124 | 6/1976 | Payne | 123/117 A |
| 4,014,169 | 3/1977 | Umino | 60/290 |

*Primary Examiner*—Douglas Hart

*Attorney, Agent, or Firm*—Cushman, Darby & Cushman

[57] ABSTRACT

In a system comprising a diaphragm type control valve with a diaphragm and a pair of chambers divided by the diaphragm, a plurality of orifices connecting the chambers and a thermo sensitive valve, the valve opening or closing period of the diaphragm type control valve is changed longer or shorter by opening and closing a bypass passage around one of the orifices by the thermo sensitive valve in response to temperature relative to the engine operating condition, whereby exhaust gas purification is attained with complete prevention of afterburn.

19 Claims, 8 Drawing Figures

EXHAUST GAS PURIFYING SYSTEM HAVING A DIAPHRAGM TYPE CONTROL VALVE

BACKGROUND OF THE INVENTION

This invention relates to a diaphragm type control valve to be used in a valve such as an intake air control valve and secondary air bypassing valve, particularly, to a new structure which enables switching over the valve operation from a short period opening to a long period opening, and vice versa.

In a conventional secondary air injection device employed in an exhaust gas purifying system for an engine, an intake air control valve and a secondary air bypassing valve have used for prevention of afterburn which takes place in the course of engine deceleration. In the valve mentioned above, there is provided a diaphragm having an orifice therein through which air flows until the pressure of two chambers divided by the diaphragm has been equalized after engine deceleration so that the valve opening period is determined. By setting the valve opening period, when the engine is decelerated the intake air control valve supplies air derived from an air pump to the intake port of the engine in a few seconds, thus proportioning the air fuel ratio to prevent misfires, and, the secondary air bypassing valve cuts the air injected into the exhaust port in the same few seconds, thus preventing the explosion of incompletely combusted gases in the exhaust pipe which is referred to as afterburn.

However, the time in which the misfires occur at the engine deceleration largely depends on engine temperature, and it is longer when the engine is cold than that when the engine is warmed up.

If the valve opening period is set to suit the warmed-up engine condition, it is too short when the engine is cold, resulting in misfires after the intake air control valve has stopped supplying air, and in turn, afterburns.

On the other hand, in the secondary air bypassing valve, the air injected into the exhaust port is cut during the valve opening period and, as a matter of course, the exhaust gas purification is stopped. Cut-off time of the air injection should be as short as possible for the exhaust gas purification.

SUMMARY OF THE INVENTION

The primary object of the present invention is to obviate the drawbacks described heretofore.

Another object of the present invention is to improve the diaphragm type control valve, wherein the valve opening or closing period is changed by at least two orifices which are switched over one from another by a thermo sensitive valve operable in response to the temperature relative to the engine condition.

According to the present invention the valve opening period of an intake air control valve or a secondary air bypassing valve is made long when the engine is in the cold condition and made short when it is warmed up so that afterburn may be completely eliminated with the effect that the exhaust gases can be purified very well.

DETAILED DESCRIPTION OF PREFERRED EMBODIMENTS

Figure 1:
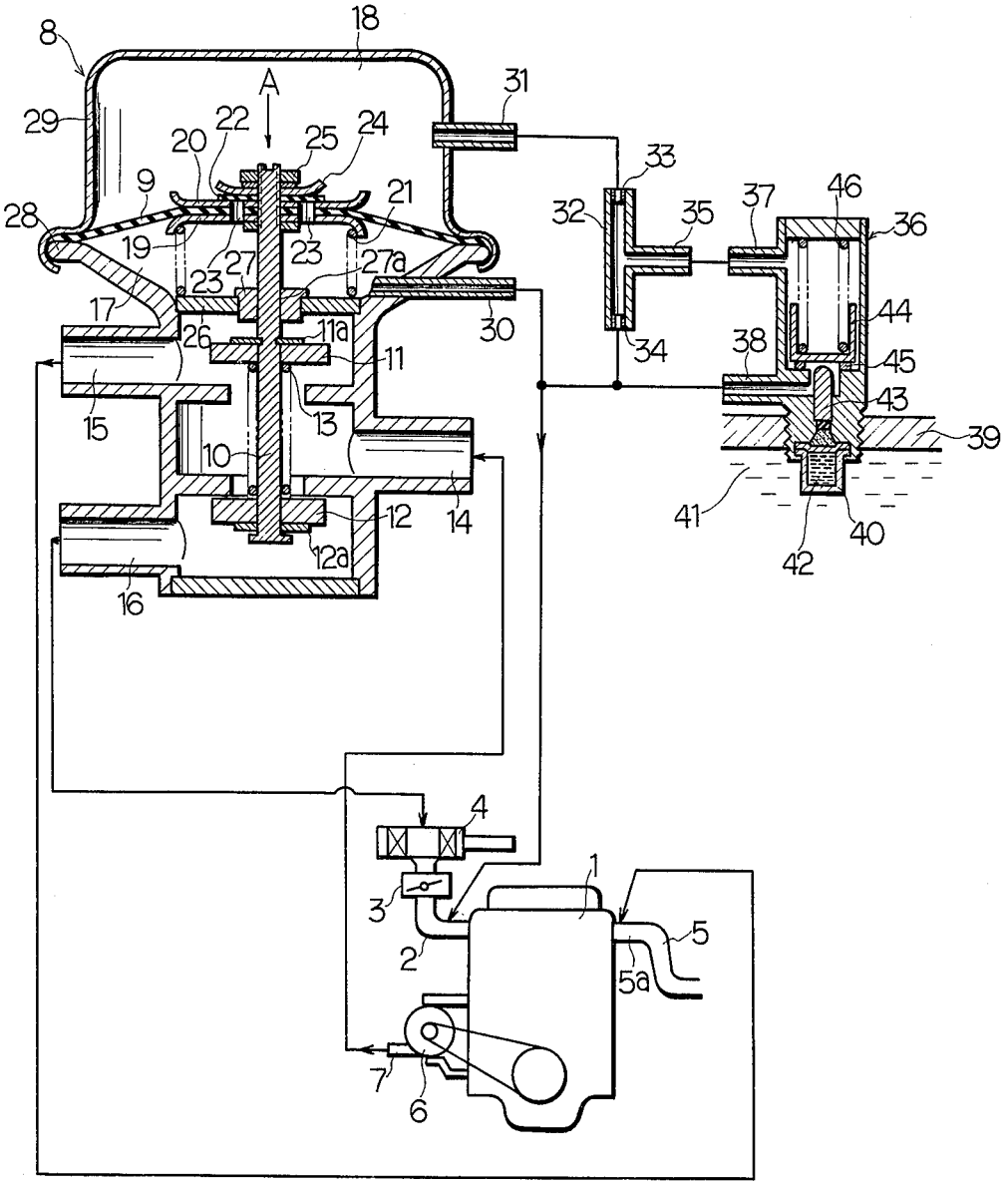
FIG. 1 is a schematic diagram showing an embodiment of the present invention suitable for a secondary air bypassing valve.

Next will be explained some embodiments with reference to drawings. FIG. 1 shows an embodiment in which a secondary air bypassing valve for an exhaust gas purifying system is employed. The secondary air bypassing valve 8 normally closes its valve 12 and opens the valve 11 by the action of a spring 21, wherein the air derived from an air pump 6 is injected into an exhaust port 5*a* of an engine 1 through an air inlet 14 and an air outlet 15 of the valve 8 to carry an exhaust gas purification.

When the engine 1 is abruptly decelerated, the negative pressure produced in an intake pipe 2 of the engine is rapidly increased, in turn, to increase negative pressure in a diaphragm chamber 17 of the valve 8 so that a diaphragm 9 of the valve 8 is pulled in the direction designated by an arrow A. Consequently, the valve 11 is closed with the valve 12 being opened and the air derived from the air pump 6 is discharged within an air cleaner 4 through a bypass opening 16, thus cutting the air injected into the exhaust port 5*a*. As a result, even if intake fuel gases are made over-rich at the beginning of deceleration of the engine to cause misfires, the afterburn does not likely take place.

As two diaphragm chambers 17 and 18 are communicated with each other via a timing chamber 32 having large and small orifices 33 and 34, and an opening 35, through which orifices 33 and 34 the air flows from the chamber 18 to the chamber 17 so that pressures in the both chambers 17 and 18 are equalized in the period determined by the size of the orifices 33 and 34 of the timing chamber. After the above period, for example, 3.5 sec. up to 4.5 sec. has passed, the diaphragm is returned, the valve 11 is reopened, and the valve 12 is reclosed, thereby to restart the air injection into the exhaust port. To the opening 35 which is interposed between the orifices 33 and 34, a thermo sensitive valve 36 is connected at its one opening 37. The small orifice 34 is also connected to another opening 38 of the thermo sensitive valve 36.

When the engine temperature is 60° C or lower in the cooling water, a valve 44 of the thermo sensitive valve 36 is positioned as shown in FIG. 1 to close the passage between the openings 37 and 38 so that the both diaphragm chambers 17 and 18 are not communicated with each other except via the series circuit of large and small orifices 33 and 34.

On the other hand, when the cooling water is, for example, hotter than 60° C, wax of a thermo sensing element 40 of the thermo sensitive valve 36 is expanded to raise a piston 43 to open the passage between the openings 37 and 38. Consequently, the small orifice 34 is short-circuited so that the time in which the both pressures are equalized is shortened to range from 1.5 sec. to 2.5 sec.

As a result, after the engine has been warmed up, the time in which the air injection is kept stopped is shortened, thereby to enhance effect of the exhaust gas purification.

It is noted that the resultant valve body 22 with holes 23 is provided on the diaphragm 9 for such a purpose that when it is sucked by the intake negative pressure in the direction designated by the arrow A and, soon thereafter, the negative pressure is decreased upon subsequent engine acceleration, it opens to permit the air flowing from the chamber 17 to the chamber 18 via the through holes 23, returning the diaphragm 9 to the original position in a short time.

Figure 2:
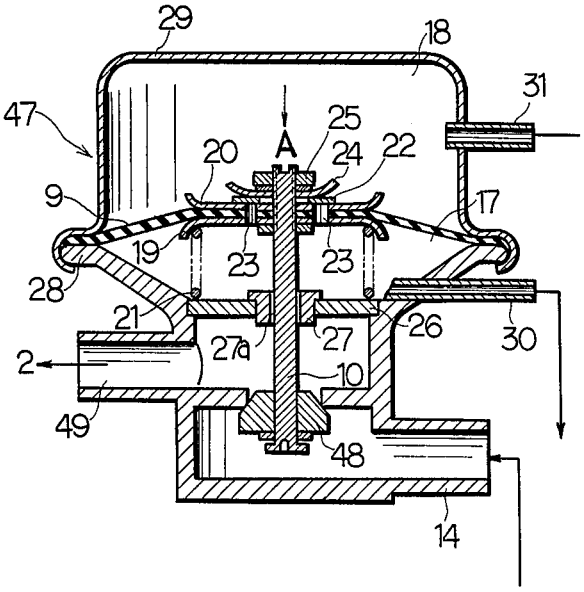
FIG. 2 is a schematic diagram partly showing an embodiment of present invention applied to an intake air control valve.

As in the embodiment shown in FIG. 1 and described above, this invention is applicable to a system comprising an intake air control valve, which is partly shown in FIG. 2. In FIG. 2, same numerals show equivalent portions.

When the engine is decelerated, the diaphragm 9 of the intake air control valve 47 is pulled in the direction designated by A and the valve 48 secured to a shaft 10 is opened so that outlet air of the airpump is supplied from an air inlet 14, through an air outlet 49, into the intake pipe 2. Other construction and operation are substantially the same as those of the former embodiment.

Besides the above described, this invention is also applicable to a dashpot type control valve which closes the throttle valve of an engine with a certain delay time after the accelerator pedal has been released for preventing sudden closure of the throttle valve.

Figure 3:
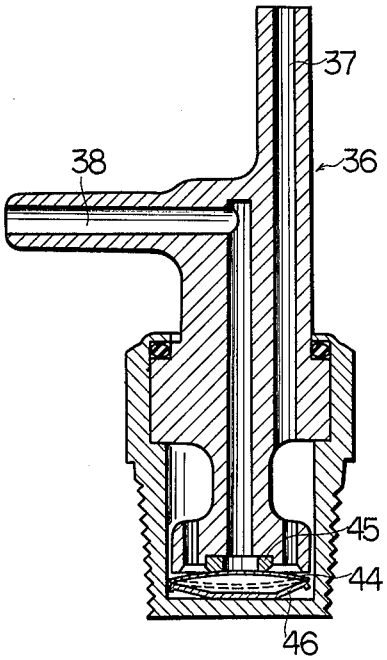
FIG. 3 is a longitudinal section of a thermo sensitive valve applied to the present invention.

As shown in FIG. 3, a bimetal type thermo sensitive valve 36 is also applicable. In the drawing, a bimetal valve 44 is provided to face a valve seat 45 with a spring 46 urging thereto, when the engine is in the cold condition, to thereby shut a passage between openings 37 and 38, while the bimetal valve 44 is deformed as shown by a dotted line in FIG. 3 to open the passage when the engine is warmed up to a preset level.

For the thermo sensitive valve 36, a ferrite type valve (not shown), which comprises a thermo ferrite having ferromagnetism diminishing at a certain temperature (Curie Point) and a permanent magnet combined with the thermo ferrite, is also applicable.

The temperature the thermo sensitive valve detects may be temperature of engine lubricating oil, engine ambient temperature, or intake or exhaust gas temperature.

Figure 4:
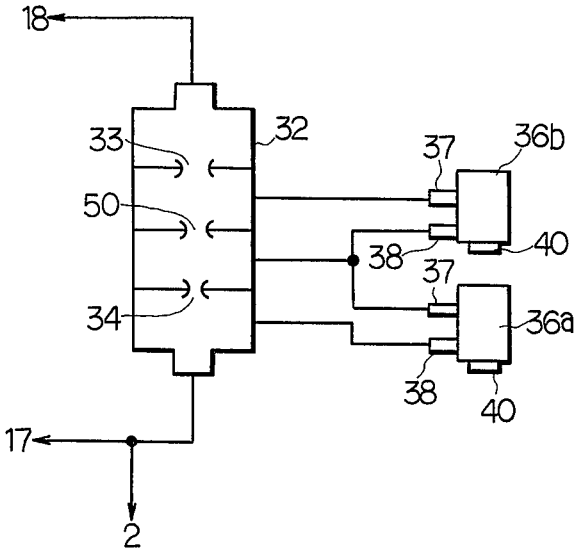
FIG. 4 is an air flow circuit diagram showing another embodiment comprising a thermo sensitive valve and a timing chamber.

In another embodiment shown in FIG. 4, the timing chamber comprises three different-sized orifices 33, 50 and 40 and two different temperature sensitive valves **36*a* and 36*b*, wherein a small orifice 34 is bypassed by a lower-temperature sensitive valve 36*a* and medium sized orifice 50 is bypassed by the other higher-temperature sensitive valve 36*b*** so that the valve opening (or closing) period can be changed in three stages in accordance with the engine temperature. By this embodiment, more enhanced effect of the exhaust gas purification with an improvement in afterburn prevention can be attained.

It should be well understood that in the case of more than three stages, orifices and thermo sensitive valves are to be added correspondingly.

Figure 5:
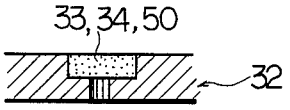
FIG. 5 is a partial section of an orifice usable in the present invention.

The orifices 33, 34 and 50 of the timing chamber 32 which are, usually, smaller than one millimeter in diameter can be replaced by a sintered metal plate or a porous ceramic plate as shown in FIG. 5.

Figure 6:
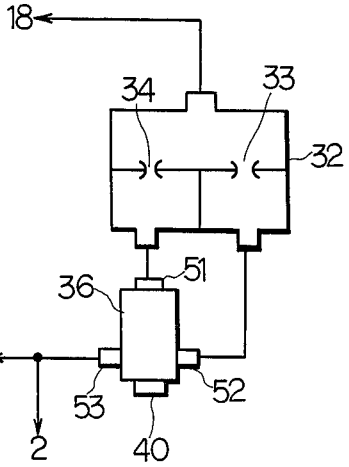
FIG. 6 is an air flow circuit diagram comprising a thermo sensitive valve and a timing chamber of the present invention.
Figure 7:
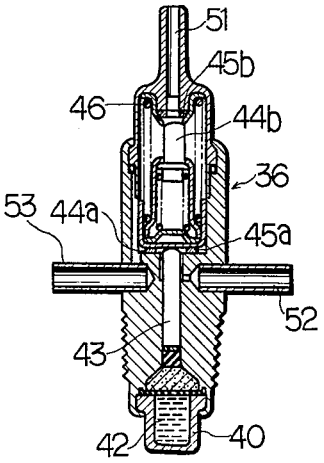
FIG. 7 is a longitudinal section of a three way valve used in the embodiment shown in FIG. 6.

As shown in FIGS. 6 and 7, the orifices 33, 34 and 50 can be arranged in parallel with each other, with the thermo sensitive valve being a three way valve.

In operation, when the engine 1 is cold, a valve **44*a* is seated on a valve 45*a* with an opening 52 being closed, and a valve 44*b* is apart from a valve seat 45*b* with a passage between openings 51 and 53 being opened, and, consequently, the passage between the chambers 17 and 18 is communicated via a small orifice 34 of the timing chamber 32**.

On the other hand, when the engine is warmed up, wax 42 is expanded to lift up the valves **44*a* and 44*b* by a piston 43 so that the valve 44*a* opens and valve 44*b* closes. As a result, the opening 51 is shut and the passage between the openings 52 and 53 are communicated, resulting in that the diaphragm chambers 17 and 18 are brought into communication through the large orifice 33 and, consequently, the valve opening periods of valves 11, 12 and 48** are changed.

Figure 8:
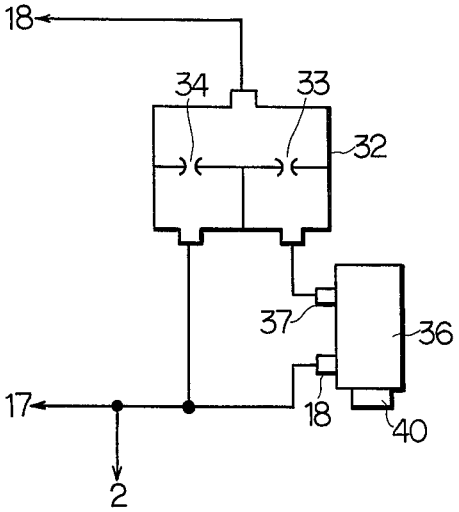
FIG. 8 is an air flow circuit diagram showing further embodiment of the present invention comprising a thermo sensitive valve and a timing chamber.

In FIG. 6, although a three way valve is employed for the thermo sensitive valve, two way valve is also applicable as shown in FIG. 8. In FIG. 8, one orifice 34 is always communicated with the diaphragm chambers 17 and 18, and the other orifice is opened or closed by the thermo sensitive valve 36.

In this instance, both the orifices 33 and 34 may be the same in size. When the engine is cold, the diaphragm chambers 17 and 18 are solely communicated through the orifice 34, on the other hand through the both orifices 33 and 34, they are communicated after the engine is warmed up.

The orifice 34 which always connects the chambers 17 and 18 may be separated from the timing chamber 32 and be formed in the diaphragm 9 instead. In this modification, clogging of the orifices can be easily prevented by providing a filter at the opening of the timing chamber 32.

In the above description, the valve opening period is made longer when the engine is cold and shorter when the engine is warmed up, however, the opposite operation can be easily obtained when any requirement is set forth.

What is claimed is:

1. An exhaust gas purifying system for an engine comprising:

a valve arrangement, having a diaphragm and a couple of chambers divided by said diaphragm, for switching on and off the air injected into an internal combustion engine in response to negative pressure introduced into one of said chambers from the engine, means connected to said couple of chambers for passing the air from one of said chambers to the other to equalize the pressures in said both chambers in one of a plurality of predetermined different time delay periods, and means, connected to said air passing means, for changing to another of said periods in response to a change in the temperature of the engine.

2. An exhaust gas purifying system claimed in claim 1, wherein:

said air passing means comprises, passage member having a pair of orifices disposed in series and a bypass passage around one of said orifices, and said period changing means comprises a thermo sensitive valve connected to said bypass passage to bypass the air flowing through the one of said orifices when the temperature of the engine is above a prescribed value.

3. An exhaust gas purifying system claimed in claim 1, wherein said valve arrangement is a secondary air bypassing valve.

4. An exhaust gas purifying system claimed in claim 1, wherein said valve arrangement is an intake air control valve.

5. An exhaust gas purifying system claimed in claim 1, wherein said air passing means comprises a wax type thermo sensitive valve.

6. An exhaust gas purifying system claimed in claim 1, wherein said air passing means comprises a bimetal type thermo sensitive valve.

7. An exhaust gas purifying system claimed in claim 1, wherein said air passing means comprises three orifices disposed in series and said period changing means comprises a couple of thermo sensitive valves connected to said air passing means so as to bypass the air flowing passage in two ways in response to a temperature of the engine.

8. An exhaust gas purifying system claimed in claim 1, wherein said air passing means comprises a porous ceramic plate.

9. An exhaust gas purifying system claimed in claim 1, wherein said air passing means comprises a passage member having a pair of orifices disposed in parallel, a first opening communicating one of said chambers with both of said orifices at one side, a second opening communicated with one of said orifices at the other side and a third opening communicated with the other orifices at the other side; and said period changing means is a three way valve with a thermo sensing element connected to said second and third openings for switching over from one to the other of said second and third openings to connect with the other of said chamber in response to the temperature of the engine.

10. An exhaust gas purifying system claimed in claim 1, wherein said air passing means comprises a passage member having a pair of orifices disposed in parallel, a first opening communicating one of said chambers with both of said orifices at their one side, a second opening communicated with one of said orifices at the other side and a third opening communicated with the other at the other side; and said period changing means is a two way valve with a thermo sensing element connected between said second opening and the other of said chamber for switching on and off the communication therebetween in response to the temperature of the engine.

11. An exhaust gas purifying system for an engine having an intake and an exhaust manifold comprising:

a source of pressurized air;

a valve arrangement having a diaphragm, first and second chambers divided by said diaphragm, said first chamber being communicated with said intake manifold so that a negative pressure in said intake manifold is applied to said first chamber, an air inlet connected to said source of pressurized air, an air outlet connected to at least one of said manifolds for supplying additional air from said source of pressurized air, and a valve attached to said diaphragm for controlling the communication between said air inlet and air outlet;

first and second air passage means connected between said first and second chambers for passing the air from one of said chambers to the other to equalize the pressure in said both chambers in one of a plurality of predetermined different time delay periods; and temperature responsive means connected at least to said second air passage means for controlling the opening and closure thereof in response to a predetermined temperature value of said engine to thereby change to another of said periods, whereby said additional air supplied to said one manifold is controlled in response to the temperature of said engine.

12. An exhaust gas purifying system claimed in claim 11, wherein:

said first and second air passage means comprises a passage member having first and second orifices disposed in series and a bypass passage around said second orifice; and said temperature responsive means comprises a thermo-sensitive valve connected to said bypass passage to bypass the air flowing through said second orifice when the temperature of said engine is above a predetermined value.

13. An exhaust gas purifying system as claimed in claim 11, wherein:

said one of said time delay periods is longer than said another of said time delay periods.

14. An exhaust gas purifying system as claimed in claim 12, wherein:

said predetermined value is 60° C of a cooling water for said engine.

15. An exhaust gas purifying system as claimed in claim 11, wherein:

said first and second air passage means comprises a passage member having first and second orifices disposed in parallel, a first opening communicating one of said chambers with both of said orifices at one side, a second opening communicated with one of said orifices at the other side and a third opening communicated with the other orifices at the other side; and said temperature responsive means is a three-way valve with a thermo sensing element connected to said second and third openings for switching over from one to the other of said second and third openings to connect with the other of said chambers in response to the temperature of the engine.

16. An exhaust gas purifying system as claimed in claim 11, wherein:

said first and second air passage means comprises a passage member having first and second orifices disposed in parallel, a first opening communicating one of said chambers with both of said orifices at their one side, a second opening communicated with one of said orifices at the other side and a third opening communicated with the other at the other side; and said temperature responsive means is a two-way valve with a thermo sensing element connected between said second opening and the other of said chambers for switching on and off the communication therebetween in response to the temperature of the engine.

17. An exhaust gas purifying system for an engine having an intake and exhaust manifold comprising:

a source of pressurized air;

a valve arrangement having a diaphragm, first and second chambers divided by said diaphragm, said first chamber being communicated with said intake manifold of an engine so that a negative pressure in said intake manifold is applied to said first chamber, an air inlet connected to said source of pressurized air, an air outlet connected to said exhaust manifold of said engine for supplying a secondary air from said source of pressurized air, and a valve attached to said diaphragm for controlling the communication between said air inlet and air outlet;

first and second air passage means connected in series with each other between said first and second chambers for passing the air from one of said chambers to the other to equalize the pressure in said both chambers in a time delay period; and temperature responsive means connected around said second air passage means for bypassing the air flowing through said second air passage means when a temperature of said engine exceeds a predetermined value, to thereby decrease said time delay period.

18. An exhaust gas purifying system for an engine having an intake and exhaust manifold comprising:

a source of pressurized air;

a valve arrangement having a diaphragm, first and second chambers divided by said diaphragm, said first chamber being communicated with said intake manifold of an engine so that a negative pressure in said intake manifold is applied to said first chamber, an air inlet connected to said source of pressurized air, an air outlet connected to said exhaust manifold of said engine for supplying a secondary air from said source of pressurized air, and a valve attached to said diaphragm for controlling the communication between said air inlet and air outlet;

first and second air passage means connected in parallel with each other between said first and second chambers for passing the air from one of said chambers to the other to equalize the pressure in said both chambers; and temperature responsive means connected between said first chamber and first and second air passage means, for opening said first air passage means and closing said second air passage means to equalize the pressure in said both chambers through said first air passage means in a first time delay period when the temperature of said engine is below a predetermined value, said temperature responsive means also opening said second air passage means and closing said first air passage means to equalize the pressure in said both chambers through said second air passage means in a second time delay period shorter than said first time delay period when said temperature of said engine is above said predetermined value.

19. An exhaust gas purifying system for an engine having an intake and exhaust manifold comprising:

a source of pressurized air;

a valve arrangement having a diaphragm, first and second chambers divided by said diaphragm, said first chamber being communicated with an intake manifold of an engine so that a negative pressure in said intake manifold is applied to said first chamber, an air inlet connected to said source of pressurized air, an air outlet connected to said exhaust manifold of said engine for supplying a secondary air from said source of pressurized air, and a valve attached to said diaphragm for controlling the communication between said air inlet and said air outlet;

first and second air passage means connected in parallel with each other between said first and second chambers for passing the air from one of said chambers to the other to equalize the pressure in said both chambers; and temperature responsive means connected between said first chamber and first air passage means for closing said first air passage means to equalize the pressure in said both chambers through said second air passage means in a first time delay period when a temperature of said engine is below a predetermined value, said temperature responsive means opening said first air passage means to equalize the pressure in said both chambers through said first and second air passage means in a second time delay period shorter than said first delay period when said temperature of said engine is above said predetermined value.

* * * * *